US006356246B1

(12) United States Patent
Nakamura et al.

(10) Patent No.: US 6,356,246 B1
(45) Date of Patent: Mar. 12, 2002

(54) DIELECTRIC LENS ANTENNA AND RADIO DEVICE INCLUDING THE SAME

(75) Inventors: Fuminori Nakamura, Nagaokakyo; Hideaki Yamada, Ishikawa-ken, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/454,166

(22) Filed: Dec. 1, 1999

(30) Foreign Application Priority Data

Dec. 2, 1998 (JP) ..... 10-343059

(51) Int. Cl.[7] ..... H01Q 15/08
(52) U.S. Cl. ..... 343/911 R; 343/909
(58) Field of Search ..... 343/753, 911 R, 343/911 L, 909, 756, 700 MS, 755, 783; 333/202, 219, 208; 342/175, 125, 72

(56) References Cited

U.S. PATENT DOCUMENTS 5,900,847 A * 5/1999 Ishikawa et al. ..... 343/909
6,008,755 A * 12/1999 Ishikawa et al. ..... 342/175
6,052,087 A * 3/2000 Ishikawa et al. ..... 343/700 MS
6,034,642 A * 5/2000 Kojima et al. ..... 343/753

* cited by examiner

*Primary Examiner*—Don Wong
*Assistant Examiner*—Chuc D. Tran
(74) *Attorney, Agent, or Firm*—Ostrolenk, Faber, Gerb & Soffen, LLP

(57) ABSTRACT

A dielectric lens antenna includes a dielectric lens, a primary radiator and a dielectric member provided between the dielectric lens and the primary radiator. The dielectric member is formed into a substantially circular cone shape, and the dielectric constant of the dielectric member is reduced continuously in the radial direction of the dielectric lens from the center line passing through the center of the dielectric lens and the primary radiator.

12 Claims, 4 Drawing Sheets

DIELECTRIC LENS ANTENNA AND RADIO DEVICE INCLUDING THE SAME

BACKGROUND OF THE INVENTION

1. Field of the Invention

The present invention relates to a dielectric lens antenna and a radio device including the same, and more particularly to a dielectric lens antenna for use in a radio device operable in a microwave band and a millimetric wave band such as a radar for preventing motorcar collisions, and a radio device including the same.

2. Description of the Related Art

In radio devices such as radars for preventing motorcar collisions and so forth, dielectric lens antennas are used as a means for controlling the directivity of radio waves. FIG. 6 is a cross section of a conventional dielectric lens antenna. The dielectric lens antenna as shown in FIG. 6 is disclosed in detail in Japanese Unexamined Patent Publication No. 6-6128.

In FIG. 6, the dielectric lens antenna 1 comprises a dielectric lens 2 having a substantially disk shape, a primary radiator 3, and a dielectric member 4 having a lower dielectric constant than the dielectric lens 2, provided between the dielectric lens 2 and the primary radiator 3. The primary radiator 3 is disposed at the back focal point of the dielectric lens 2. The dielectric member 4 is formed in a substantially circular cone shape in which the primary radiator 3 is positioned at the apex, and the dielectric lens 2 is provided at the base, and its dielectric constant is uniform. Further, the dielectric lens 2 and the primary radiator 3 are connected through and secured to the dielectric member 4.

In the dielectric lens antenna 1 configured as described above, the thickness of the dielectric lens 2 can be reduced, and moreover, it is unnecessary to provide a holder for holding the dielectric lens 2 at a predetermined position with respect to the primary radiator 3.

For reduction of the thickness of such a dielectric lens antenna, there are proposed methods of increasing the dielectric constant of a dielectric lens in order to make the dielectric lens thinner, shortening the back focal distance of the dielectric lens so that the distance between the dielectric lens and the primary radiator is reduced, or increasing the dielectric constant of a dielectric member so that the distance between the primary radiator and the dielectric lens is reduced, and so forth.

However, there is the problem that when the dielectric constant of a dielectric lens is increased, the efficiency of the dielectric lens itself is reduced.

Further, to reduce the back focal distance of the dielectric lens, it is necessary to increase the thickness of the dielectric lens, and as a whole, the thickness of the dielectric lens antenna can not be reduced. Further, this causes the problem that the efficiency deteriorates. Further, since materials with which dielectric lenses are formed have a high heat shrinkage, dielectric lenses which are thick can not be injection-molded with high dimensional precision.

In the methods for increasing the dielectric constant of the dielectric member, phase-shifting increases, due to the routes of radio waves between the primary radiator and the dielectric lens. Accordingly, there is the problem that the dielectric lens antenna can not operate normally.

SUMMARY OF THE INVENTION

Accordingly, it is an object of the present invention to solve the above-described problems, and provide a dielectric lens antenna which can be thinner and having a high efficiency.

It is also an object of the invention to provide a radio device including such a dielectric lens antenna.

To achieve the above object, according to the present invention, there is provided a dielectric lens antenna which comprises a dielectric lens, a primary radiator, and a dielectric member provided between the dielectric lens and the primary radiator, the dielectric member having a dielectric constant distributed nonuniformly therein.

Preferably, in the dielectric lens antenna of the present invention, the dielectric member is formed into a substantially circular cone shape in which the dielectric lens is positioned on the base, and the primary radiator is provided at the apex, and the dielectric constant is reduced in the radial direction of the dielectric lens from a center line thereof passing through the center of the dielectric lens and the primary radiator.

Preferably, in the dielectric lens antenna of the present invention, the dielectric member has such a configuration that the dielectric constant is reduced continuously in the radial direction of the dielectric lens in conformity to a substantially circular cone pattern.

In the dielectric lens antenna of the present invention, the dielectric member is preferably formed of plural layers each having a substantially circular cone shape so that the dielectric constant is reduced stepwise in the radial direction of the dielectric lens.

Preferably, in the dielectric lens antenna of the present invention, the thickness of the largest area portion in each layer having an even dielectric constant in the dielectric member is up to the effective wavelength of the radio wave with a used frequency in the layer.

A radio device according to the present invention includes any one of the above-described dielectric lens antennas.

With the configuration as described above, the dielectric lens antenna of the present invention can be rendered of high efficiency and can be made thinner.

The radio device of the present invention can be miniaturized, due to the thinning of the dielectric lens antenna.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

Figure 1:
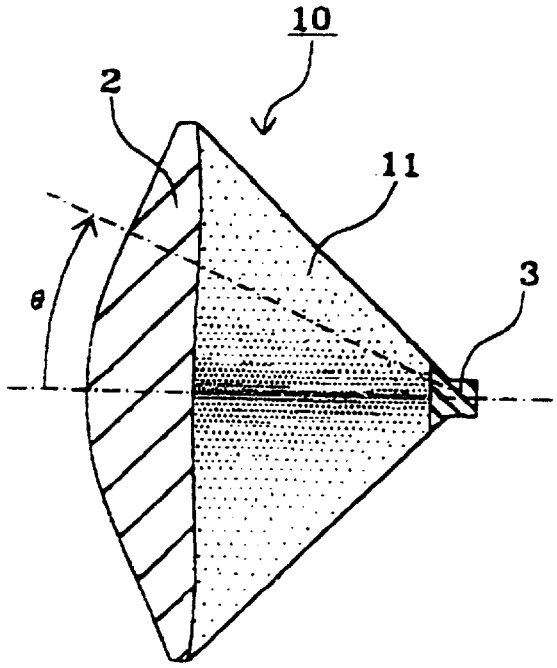
FIG. 1 is a cross section of a dielectric lens antenna according to an embodiment of the present invention.
Figure 6:
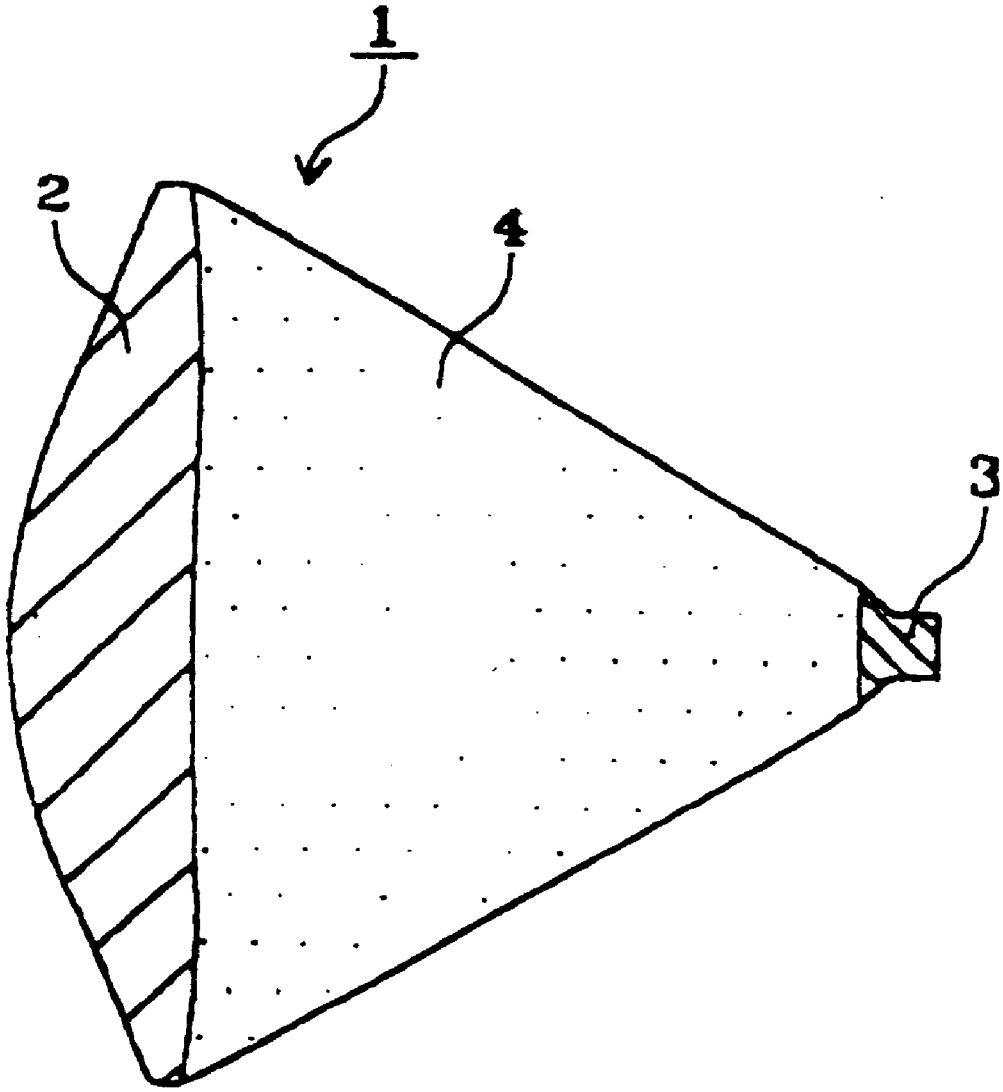
FIG. 6 is a cross section of a conventional dielectric lens antenna.

FIG. 1 is a cross section of a dielectric lens antenna according to an embodiment of the present invention. The same or equivalent parts in FIGS. 1 and 6 are designated by the same reference numerals, and the description is omitted.

As shown in FIG. 1, a dielectric member 11 provided between the dielectric lens 2 and the primary radiator 3 of a dielectric lens antenna 10 is formed into a substantially circular cone shape with the primary radiator 3 positioned at the apex, and the dielectric lens 2 provided at the base. The dielectric constant is unevenly distributed. More particularly, in the dielectric member 11, the dielectric constant is reduced continuously in the radial direction (the direction from the center toward the outside) of the dielectric lens 2 from the center line passing through the center of the dielectric lens 2 and the primary radiator 3, in conformity to a substantially circular cone pattern.

In this case, the change of the dielectric constant of the dielectric member 11 is determined in accordance with the following equation (1), for example.

$$\in(\ominus)=(\in o+\tan^2(\ominus))\times\mathrm{Cos}^2(\ominus) \quad (1)$$

in which $\in$o designates the relative dielectric constant of the dielectric member 11 at the center thereof, $\ominus$ the angle ($0\leqq\ominus\leqq\pi/2$), hereinafter, referred to as primary radiation angle) from the straight line as a standard, passing through the center of the dielectric lens 2 and the primary radiator 3 to the straight line passing through the primary radiator 3 and a position distant from the center of the dielectric lens 2 in the radial direction, and $\in\ominus$ is the function in which the relative dielectric constant is expressed by the primary radiation angle e as a variable. That is, the relative dielectric constant $\in\ominus$o of each portion of the dielectric member 11 is automatically determined according to the equation (1) when the relative dielectric constant o of the center portion is determined as an initial value.

Figure 2:
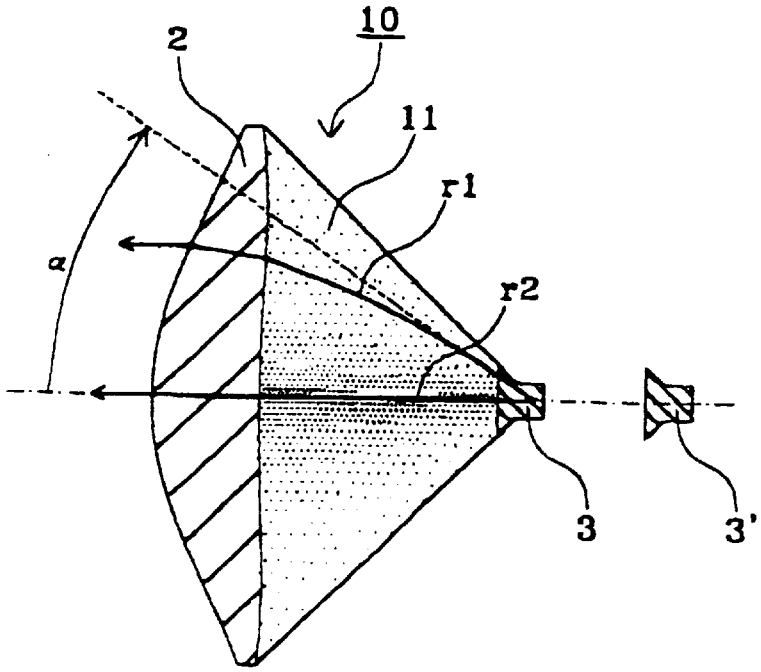
FIG. 2 is a cross section showing the route of a radio wave in the dielectric lens antenna of FIG. 1.

Hereinafter, the operation of the dielectric lens antenna of the present invention will be described with reference to FIG. 2. FIG. 2 shows a primary radiator 3' disposed at the back focal point of the dielectric lens 2 in the case that the dielectric member 11 is absent, in addition to the dielectric lens antenna 10 of the present invention as shown in FIG. 1.

In general, a radio wave propagates quickly in a dielectric which has a low dielectric constant, and propagates slowly in a dielectric with a high dielectric constant. In other words, this means the presence of wavelength shortening effects which are small when the dielectric constant is low, and are great at a high dielectric constant. Further, the radio wave has the property that where high and low dielectric constants are present, the radio wave is bent toward the dielectric having the high dielectric constant.

Therefore, in the dielectric lens antenna 10, the radio wave r1 radiated from the primary radiator 3 at a primary radiation angle of $\alpha$ propagates in the dielectric member 11 while being bent toward the dielectric having a high dielectric constant, namely, toward the center direction of the circular cone, to reach the back side of the dielectric lens 2. On the other hand, the radio wave r2 radiated from the primary radiator 3 at a primary radiation angle of 0° propagates rectilinearly to reach the center of the dielectric lens 2. Comparing the radio waves r1 and r2 with respect to the distance over which a radio wave radiated from the primary radiator 3 propagates to reach the back side of the dielectric lens 2, the distance for the radio wave r1 is longer than that for the radio wave r2. However, the radio wave r1 propagates in the dielectric having a lower dielectric constant than the radio wave r2, and therefore, the propagation rate is high. As a result, the radio waves r1 and r2 reach the back side of the dielectric lens antenna 2 substantially at the same time. This behavior is the same for radio waves radiated at other primary radiation angles. Accordingly, phase shifts caused by the different routes of radio waves from the primary radiator 3 to the dielectric lens 2 can is ignored. This effect can not be obtained in the case that the dielectric member has a uniform dielectric constant.

Further, a radio wave radiated from the primary radiator 3 propagates while being bent toward the dielectric having a high dielectric constant, that is, toward the center direction of the circular cone. Accordingly, the radio wave can be concentrated along the center direction of the dielectric lens 2. The efficiency can be enhanced, since the leakage of radio waves into the outside of the dielectric lens 2 is reduced.

Further, since the radio wave radiated from the primary radiator 3 propagates in the dielectric member 11, the number of radio waves present between the primary radiator 3 and the dielectric lens 2 is equal to that obtained when the primary radiator 3 is disposed more distant from the dielectric lens 2, namely, at the position designated by reference numeral 3' in the state that the dielectric member 11 is not provided. In other words, by providing the dielectric member 11, the distance between the primary radiator 3 and the dielectric lens 2 can be shortened (the back focal distance can be shortened). This means that the dielectric lens antenna 10 can be made thinner.

Further, with the dielectric member 11, the back focal distance can be shortened. Therefore, it is unnecessary to reduce the back focal distance by thickening the lens 2 itself. To the contrary, the efficiency can be enhanced by further thinning the dielectric lens 2.

Moreover, the phases of radio waves which depend on the routes of the radio waves can be controlled by adjustment of the gradient of changes in dielectric constant in the dielectric member 11. This can enhance the design flexibility for the dielectric lens antenna.

Further, by changing the dielectric constant of the dielectric member 11, dielectric lens antennas having various thicknesses can be designed, utilizing a dielectric lens having a thickness and a back focal distance which are constant, designed under the condition that the dielectric member 11 is not provided. Accordingly, a metal mold for producing dielectric lens can be used in common. The development time-period for a dielectric lens antenna can be reduced, and the design and manufacturing cost can be reduced.

Figure 3:
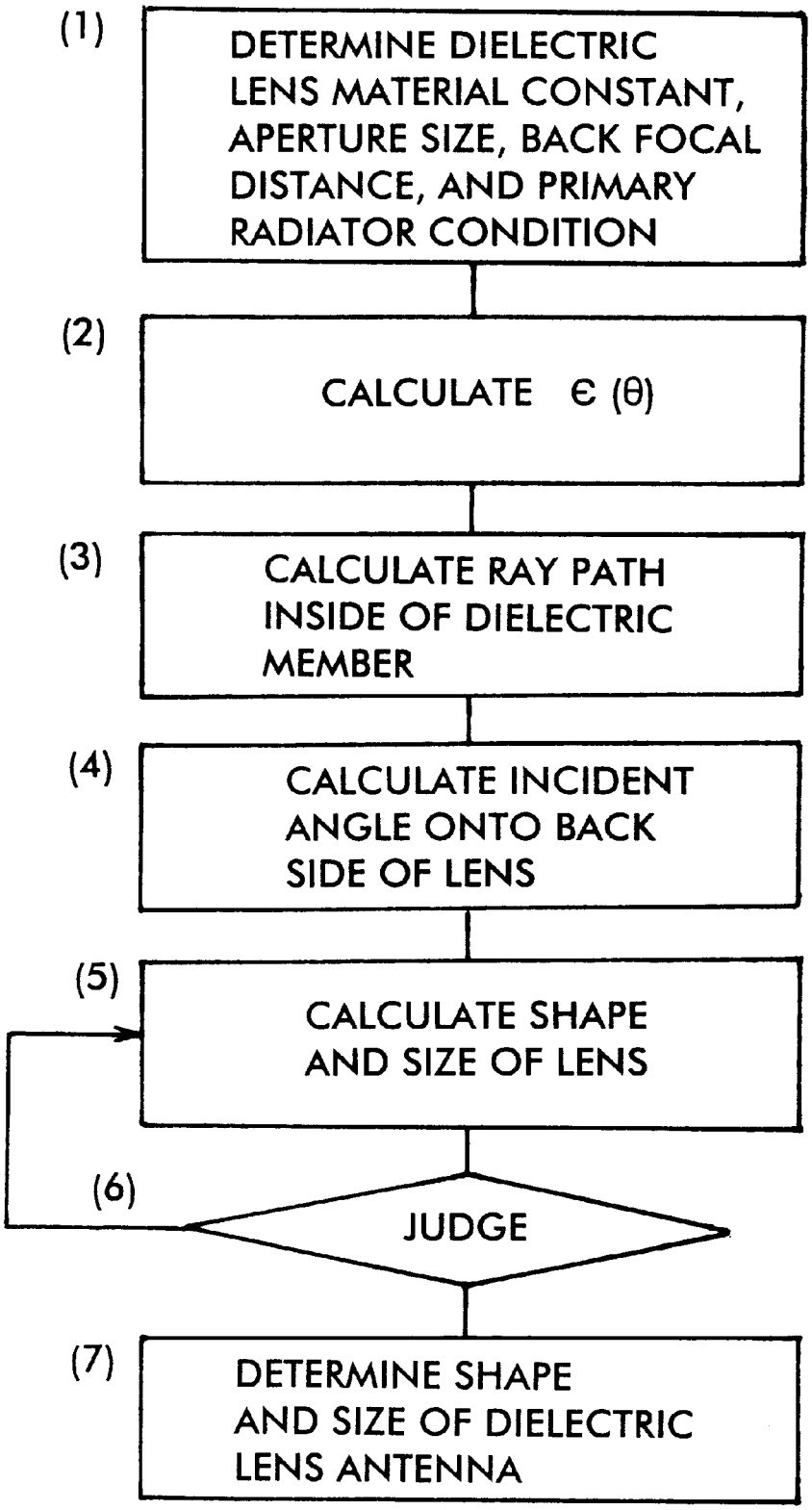
FIG. 3 is a flow chart showing a method of designing the dielectric lens antenna of the present invention.

Hereinafter, a method of designing the dielectric lens antenna of the present invention will be described by use of the flow chart shown in FIG. 3.

As a first procedure, the constants of dielectric lens materials, the aperture size, the back focal distance, and the conditions of the primary radiator such as the interval between the primary radiator and the dielectric lens are determined, based on the specifications of the dielectric lens antenna.

As a second procedure, the dielectric constant $\in\ominus$ of the dielectric member at the center thereof is determined based on the interval between the dielectric lens and the primary radiator. Further, the dielectric constants of the dielectric member at every primary radiation angle are calculated by use of the equation (1), for example.

Then, as a third procedure, a ray path (path for a radio wave) from the primary radiator to the dielectric lens in the dielectric member is calculated.

Next, as a fourth procedure, the incident angle of a radio wave to the back side of the dielectric lens is calculated.

Then, as a fifth procedure, the shape and size of a dielectric lens is calculated from simultaneous equations formed by use of Snell's law, phase conditions, and the energy conservation law. In this case, plural solutions for the shape and size of the dielectric lens may be given. Accordingly, one of them is selected.

Finally, as a sixth procedure, it is judged whether the shape and size of the lens determined by the fifth procedure is optimal. The fifth procedure is repeated, if necessary, to calculate another shape and size of the dielectric lens so that the optimal shape and size of the dielectric lens for the dielectric lens antenna can be obtained.

As described above, a dielectric lens antenna which is thin and has a high efficiency can be designed.

The dielectric constant of the dielectric member need not necessarily be calculated by using equation (1). It may be determined by calculation according to another method.

Figure 4:
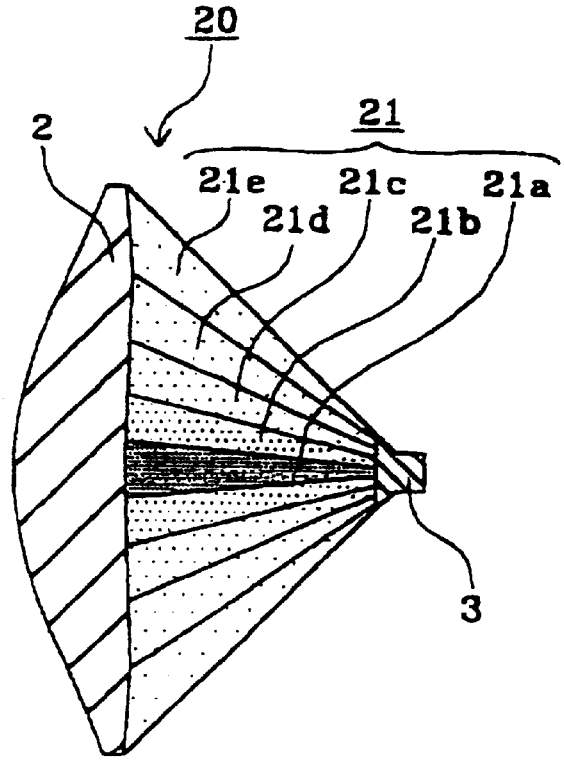
FIG. 4 is a cross section of a dielectric lens antenna according to another embodiment of the present invention.

FIG. 4 is a cross section of a dielectric lens antenna according to another embodiment of the present invention. The same or equivalent parts in FIGS. 4 and 1 are designated by the same reference numerals, and the description is omitted.

In FIG. 4, a dielectric member 21 provided between the dielectric lens 2 and the primary radiator 3 of a dielectric lens antenna 20 is formed by overlaying five layers 21*a*, 21*b*, 21*c*, 21*d*, and 21*e* having different dielectric constants so as to form a substantially circular cone shape in which the primary radiator 3 is positioned at the apex and the dielectric lens 2 is provided at the base. More particularly, in the dielectric member 21, the dielectric constants of the five layers are reduced stepwise in the radial direction of the dielectric lens 2 from the center line passing through the center of the dielectric lens 2 and the primary radiator 3. In addition, the maximum thickness of each layer of the dielectric member 21, that is, the thickness of the portion of each layer which is in contact with the dielectric lens 2 is set so as to be up to the effective wavelength of the radio wave with a frequency used in the layer. By this method, in the dielectric member 21, the pseudo-gradient structure of the dielectric constant is realized.

The dielectric constant of each layer in the dielectric member 21 may be determined by calculating according to equation (1) in which the primary radiation angle $\Theta$ is set to be a maximum, a minimum, or a value between them in each layer. The dielectric constant of each layer may be determined by another method.

In the dielectric lens antenna 20 configured as described above, since the thickness of each layer in the dielectric member 21 is set so as to be up to the effective wavelength of a radio wave with a use frequency in the layer, the dielectric member 21 operates substantially equivalently to the dielectric member 11 of the dielectric lens antenna 10 of FIG. 1, and operation and advantages similar to those of the dielectric lens antenna 10 can be obtained. In addition, the dielectric member 21 can be produced relatively simply as compared with the dielectric member 11, and cost-saving of the dielectric lens antenna 20 can be achieved.

Figure 5:
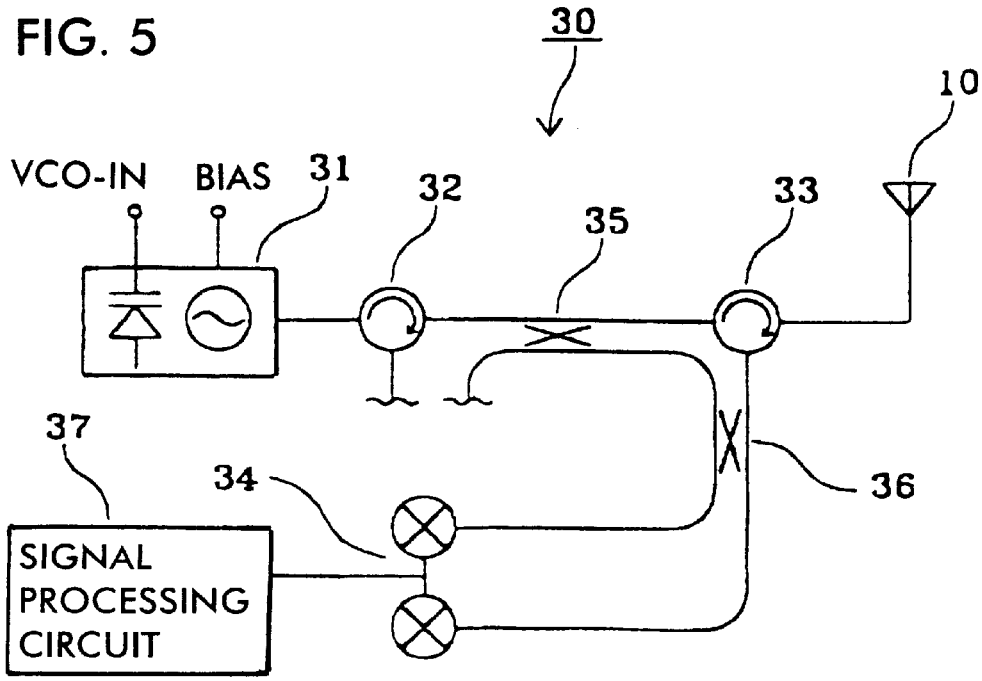
FIG. 5 is a block diagram of a radio device according to an embodiment of the present invention.

FIG. 5 shows a block diagram of a millimetric wave radar to be mounted onto a motorcar as an embodiment of the radio device of the present invention. In FIG. 5, a millimetric wave radar device 30 comprises a dielectric lens antenna 10 as shown in FIG. 1, an oscillator 31, circulators 32 and 33, a mixer 34, couplers 35 and 36, and a signal processing circuit 37.

In the millimetric radar device 30 configured as described above, the oscillator 31, including a Gunn diode as an oscillating component and a varactor diode as an oscillating frequency control component, constitutes a voltage controlled oscillator. To the oscillator 31, a bias voltage for the Gunn diode, and a control voltage VCO-IN for frequency modulation are input. A transmitting signal which is the output, passed through a circulator 32 with the reflection signal being prevented from returning, is input to a coupler 35. The transmitting signal is divided into two parts in the coupler 35. One is radiated from the dielectric lens antenna 10 through a circulator 33, and the other is input to a circulator 36 as a local signal. Further, a signal received through the dielectric lens antenna 10 is input to a coupler 36 through the circulator 33. The coupler 36 operates as a 3 dB directive coupler, and divides the local signal sent from the coupler 35 equally with a phase difference of 90° to input the divided signals to the two mixer circuits of a mixer 34, and also, divides a receiving signal sent from the circulator 33 equally with a phase difference of 90° to input to the two mixer circuits of the mixer 34. In the mixer 34, the two signals in which the local signal and the receiving signal are mixed are balanced-mixed, and the frequency difference component of the receiving signal and the local signal is output as an IF signal and input to the signal processing circuit 37.

In the above-described millimetric wave radar device 30, by applying a triangular-wave signal as the above-mentioned VCO-IN signal, distance information and relative velocity information can be determined based on the IF signal in the signal processing circuit 37. Accordingly, when the millimetric-wave radar device is mounted onto a motorcar, the relative distance and relative velocity of another motorcar can be measured. Moreover, when the dielectric lens antenna of the present invention is used, miniaturization of the millimetric-wave radar device 36 is enabled, due to the thinning of the dielectric lens antenna, which facilitates its mounting onto a motorcar. In addition, since the efficiency of the dielectric lens antenna is enhanced, the parts of the millimetric wave radar device 30, excluding the dielectric lens antenna, can be conveniently designed. Cost-savings can be achieved.

The dielectric lens antenna of the present invention comprises a dielectric lens, a primary radiator, and a dielectric member provided between the dielectric lens and the primary radiator, the dielectric member formed in a substantially circular cone shape in which the dielectric lens is positioned on the base, and the primary provided is done at the apex, and the dielectric constant is reduced in the radial direction of the dielectric lens from a center line passing the center of the dielectric lens and the primary radiator. Further, the dielectric member may be configured so that the dielectric constant is reduced continuously in the radial direction of the dielectric lens in conformity to a substantially circular cone pattern. Further, the dielectric member may be formed of plural layers each having a substantially circular cone shape so that the dielectric constant is reduced stepwise in the radial direction of the dielectric lens, and the thickness of each layer may be up to the effective wavelength of the radio wave with a use frequency in the layer. With these configurations, thinning and enhancement in efficiency of the dielectric lens antenna can be achieved.

The radio device of the present invention, including the dielectric lens antenna of the present invention, can be miniaturized, and can be simply mounted onto a motorcar. In addition, since the efficiency of the dielectric lens antenna is enhanced, the other parts of the radio device can be simply designed, which realizes cost-savings.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric lens antenna comprising a dielectric lens, a primary radiator and a dielectric member provided between said dielectric lens and said primary radiator, said dielectric member having a substantially circular cone shape and having a dielectric constant distributed non-uniformly therein.

2. The dielectric lens antenna according to claim 1, wherein said dielectric member is formed into a substantially circular cone shape having a base and apex, in which said dielectric lens is positioned at the base and the primary radiator is positioned at the apex, and the dielectric constant is reduced in a radial direction of said dielectric lens from a center line passing through the center of the dielectric lens and the primary radiator.

3. The dielectric lens antenna according to claim 2, wherein said dielectric member is configured so that said dielectric constant is reduced continuously in the radial direction of the dielectric lens in conformity to a substantially circular cone pattern.

4. The dielectric lens antenna according to claim 2, wherein said dielectric member comprises plural layers each having a substantially circular conical shape so that the dielectric constant is reduced stepwise in the radial direction of the dielectric lens.

5. The dielectric lens antenna according to claim 4, wherein each layer has a uniform dielectric constant and wherein the thickness of a largest area portion in each layer in the dielectric member is up to an effective wavelength of a radio wave with a use frequency in the layer.

6. A radio device including a dielectric lens antenna comprising a dielectric lens, a primary radiator and a dielectric member provided between said dielectric lens and said primary radiator, said dielectric member having a substantially circular cone shape and having a dielectric constant distributed non-uniformly therein.

7. The radio device of claim 6, wherein said dielectric member is formed into a substantially circular cone shape having a base and apex, in which said dielectric lens is positioned at the base and the primary radiator is positioned at the apex, and the dielectric constant is reduced in a radial direction of said dielectric lens from a center line passing through the center of the dielectric lens and the primary radiator.

8. The radio device according to claim 7, wherein said dielectric member is configured so that said dielectric constant is reduced continuously in the radial direction of the dielectric lens in conformity to a substantially circular cone pattern.

9. The radio device according to claim 7, wherein said dielectric member comprises plural layers each having a substantially circular conical shape so that the dielectric constant is reduced stepwise in the radial direction of the dielectric lens.

10. The radio device according to claim 9, wherein each layer has a uniform dielectric constant and wherein the thickness of a largest area portion in each layer in the dielectric member is up to an effective wavelength of a radio wave with a use frequency in the layer.

11. The dielectric lens antenna according to claim 1 wherein the dielectric member is solid.

12. The radio device according to claim 6, wherein the dielectric member is solid.

* * * * *